US008627674B2

(12) United States Patent
Platt

(10) Patent No.: US 8,627,674 B2
(45) Date of Patent: Jan. 14, 2014

(54) MODULAR OUTBOARD HEAT EXCHANGER AIR CONDITIONING SYSTEM

(76) Inventor: Mark Platt, Sparta, WI (US)

( * ) Notice: Subject to any disclaimer, the term of this patent is extended or adjusted under 35 U.S.C. 154(b) by 611 days.

(21) Appl. No.: 12/465,105

(22) Filed: May 13, 2009

(65) Prior Publication Data

US 2010/0031686 A1 Feb. 11, 2010

Related U.S. Application Data

(60) Provisional application No. 61/053,553, filed on May 15, 2008.

(51) Int. Cl.
*F25D 19/00* (2006.01)

(52) U.S. Cl.
USPC ..... 62/298; 62/259.1

(58) Field of Classification Search
USPC ..... 62/298, 259.1, 498, 201, 175, 180, 434, 62/436; 312/401, 187, 243
See application file for complete search history.

(56) References Cited

U.S. PATENT DOCUMENTS 5,036,677 A * 8/1991 Neuenfeldt et al. ..... 62/259.1
5,070,704 A * 12/1991 Conry ..... 62/175
5,348,081 A * 9/1994 Halstead et al. ..... 165/144
5,906,104 A * 5/1999 Schwartz et al. ..... 62/79
6,098,657 A * 8/2000 Sugg ..... 137/546
6,276,152 B1 * 8/2001 Sibik ..... 62/201
6,415,620 B1 * 7/2002 Ferdows ..... 62/244
6,751,975 B1 * 6/2004 Reimann ..... 62/279
6,763,669 B1 * 7/2004 Bushnell et al. ..... 62/115
6,886,358 B2 * 5/2005 Hille et al. ..... 62/244
6,976,365 B2 * 12/2005 Forkosh et al. ..... 62/94
7,032,399 B2 * 4/2006 Czechowicz et al. ..... 62/244
7,096,925 B2 * 8/2006 Bracciano ..... 165/42
7,845,185 B2 * 12/2010 Knight et al. ..... 62/196.4
2001/0001363 A1 * 5/2001 Dodge et al. ..... 62/240
2002/0124579 A1 * 9/2002 Tisdale et al. ..... 62/98
2002/0194860 A1 * 12/2002 Goodman et al. ..... 62/324.1
2003/0147216 A1 * 8/2003 Patel et al. ..... 361/700
2004/0221597 A1 * 11/2004 Hille et al. ..... 62/244
2004/0221598 A1 * 11/2004 Hille et al. ..... 62/244
2004/0256082 A1 * 12/2004 Bracciano ..... 165/42
2005/0103032 A1 * 5/2005 Pierson ..... 62/175
2005/0229921 A1 * 10/2005 Krupp ..... 126/298
2006/0055193 A1 * 3/2006 Colborne ..... 296/24.3
2006/0070400 A1 * 4/2006 Tamburrino ..... 62/504
2007/0261421 A1 * 11/2007 Pierson ..... 62/175
2008/0034776 A1 * 2/2008 Jensen ..... 62/305

* cited by examiner

*Primary Examiner* — Mohammad M Ali
(74) *Attorney, Agent, or Firm* — Keith H. Orum; Orum & Roth, LLC

(57) ABSTRACT

The invention discloses a modular air conditioning, heating, and heat recovery system. Particularly, the invention discloses a modular system having the condenser and/or evaporator heat exchangers mounted outboard of the modules and being easily removable and separatable by virtue of their positioning and valving.

5 Claims, 6 Drawing Sheets

MODULAR OUTBOARD HEAT EXCHANGER AIR CONDITIONING SYSTEM

This application claims the benefit of U.S. Provisional Application 61/053,553 filed 15 May 2008.

BACKGROUND OF THE INVENTION

1. Field of the Invention

This invention relates to modular refrigeration systems and relates particularly to such refrigeration systems for use in air conditioning installations. The invention discloses a unique outboard arrangement of the evaporator and condenser heat exchangers for facilitating removal and maintenance of those elements.

Air conditioning installations for modern buildings, such as large office structures, shopping complexes, warehouses and the like, conventionally comprise air treatment units to which water or other heat exchange fluid is pumped whereby air is cooled (in summer) or heated (in winter) and circulated to the areas to be conditioned. The heat exchange fluid for cooling is generally circulated through an evaporator/chiller of a refrigeration system which removes heat from the fluid. The heat is given up to a second heat exchange fluid which circulates passed the condenser of the refrigeration system. The second heat exchange fluid may also comprise water or other liquid or may comprise air in an air cooled or evaporative cooler system. Such systems may also be designed to operate on reverse cycle and act as heat pumps to heat the air to be conditioned. The refrigeration system will, of course, have cooling/heating capacity appropriate to the capacity of the air conditioning installation. Alternatively, the system may be arranged as a dedicated heat recovery system, whereby the system will be sized to maximize the heat recovery requirement.

For high capacity installations, as may be incorporated in office and apartment complexes, a refrigeration system of high output is necessary to be able to handle the maximum load expected. In practice, such high output refrigeration systems tend to be more prone to breakdown and failure than do lower output refrigeration units. Such breakdowns and failures often leave the building in which the system is installed without any air conditioning until the breakdown or failure is remedied. In high capacity systems, breakdowns and failures can often take days and, sometimes, weeks to repair.

Further, in the design and construction of many modern building structures, provision is made for the expansion of the building structure, that is, the building is constructed in a number of stages spread over a period of time. Because of the difficulty in expanding a predesigned air conditioning system, it is generally necessary to design and install the system to have the air conditioning capacity for the completed building structure. This means, therefore, that the system is running, inefficiently, at less than full load capacity until such time as all building stages are completed.

In other instances, building structures are extended after the initial design and construction, and such extensions often require the air conditioning system for the initial building structure to be completely replaced with a new system to be able to handle the load of the extended building structure. Further, in densely populated urban areas, such as New York City, transportation of a conventional single large unit may require a shutdown of traffic routes during transportation of the unit to its installation location. Shutdowns are extremely difficult to arrange and result in extremely high costs. These problems are completely avoided by the present invention.

2. Description of Related Art

In the past, the condensers for refrigeration units have been connected in series as are the water circuits of the evaporator/chillers thus requiring each refrigeration unit to have individual design criteria in accordance with the variation in temperature of the water circulating through the individual, series connected condensers and evaporator/chillers.

It is desirable to provide an improved refrigeration system which obviates the disadvantages of the known systems.

It is also desirable to provide an improved refrigeration system which allows the design and construction of an air conditioning system for a building or like structure, which air conditioning system is less prone to breakdown and failure than known air conditioning systems.

It is also desirable to provide an improved refrigeration system particularly for air conditioning and in which a breakdown or failure of part of the refrigeration system does not prevent operation of the air conditioning plant.

It is further desirable to provide an improved air conditioning system using discrete refrigeration units which can be removed, repaired and/or replaced without major disruption of the operation of the air conditioning system.

It is a further object of the invention to provide condenser and/or evaporator heat exchangers outboard from the other component of a module, and isolatable through valving, to facilitate the removal and maintenance of these elements.

BRIEF SUMMARY OF THE INVENTION

According to one aspect of the present invention there is provided a refrigeration system formed by a plurality of modular units, each unit comprising at least one refrigeration circuit separate from the or each circuit of the or each other unit, a support structure or housing carrying the or each circuit of the unit, said support structure accommodating at least one passage for flow of heat exchange fluid in heat exchange relation with at least one heat exchange element of the circuit, said flow passage being adapted for communication with a corresponding flow passage of the or each other unit, and control means for controlling operation of the assembly of units.

Each modular unit preferably has an evaporator circuit in the housing and separated from a condenser circuit in the housing. With this arrangement, the housing defines one passage for the flow of heat exchange fluid in heat exchange relation with the evaporator circuit and a second passage for flow of a second heat exchange fluid in heat exchange relation with the condenser circuit. The module include separate evaporator and/or condenser heat exchangers. These heat exchangers may be mounted outboard of the other elements of the module, and may be isolatable by valving.

In a particular form of the invention, headers are provided on or incorporated in the housing to convey heat exchange fluid to and from the flow passages in the housing. The headers of each housing are adapted to be connected to headers of the or each adjacent unit. In one embodiment, the headers are arranged inboard of the evaporator and/or condenser heat exchangers.

In various embodiments the condenser and/or evaporator may be mounted above, below, or to the side of the header pipes.

The condenser and/or evaporator are totally arranged to be removable unimpeded by any other elements of the modular unit.

Preferably, the control system is operative to cause progressive actuation of the units in sequence in response to increasing load demand, the sequence of actuation being automatically changed at periodic intervals whereby to substantially equalize usage of all units over a prolonged period. In a particularly preferred embodiment, one of the modular units is designated a master unit and is provided with electric control means to which other, slave units are connected whereby operation of all units is controlled by the master unit. The control means so arranged that, in the event of a failure of one of the modular units, that unit is electrically disconnected from service and an appropriate alarm indication is given. For this purpose, each modular unit is provided with appropriate sensors to monitor operation of the respective units.

According to another aspect of the invention there is provided a refrigeration system comprising a plurality of refrigeration units, each unit having compressor means, a refrigerant condensing circuit incorporating a condenser, a refrigeration evaporator circuit incorporating an evaporator, means for circulating a first heat exchange fluid passed the evaporator and means for circulating a second heat exchange fluid passed the condenser, characterized in that each unit includes a modular support structure or housing for the respective evaporator and the respective condenser, the support structure accommodating at least one flow passage for the first heat exchange fluid in heat exchange relation with the evaporator, structure for mounting the compressor, header structure for supplying the first heat exchange fluid to said at least one flow passage and for conveying said fluid therefrom, and structure for passing the second heat exchange fluid through the condenser.

In the most preferred form, each modular housing has sides which abut opposed sides of adjacent units, the header structure of abutted units being interconnected to form common manifolds for supply and return of the respective heat exchange fluids. Each unit preferably comprises two refrigerant compressors with separate condenser and evaporator circuits. The modular structure houses one or more evaporators in one compartment which defines a single flow passage for the first heat exchange fluid. The modular structure of each unit also houses one or more condensers in a second compartment which defines a single flow passage for the second heat exchange fluid.

Each said header structure may comprise a fluid supply pipe and a fluid return pipe communicating with the respective flow passages, the supply and return pipes of each unit having connection means for coupling two respective pipes of adjacent units.

DETAILED DESCRIPTION OF THE INVENTION

Figure 1:
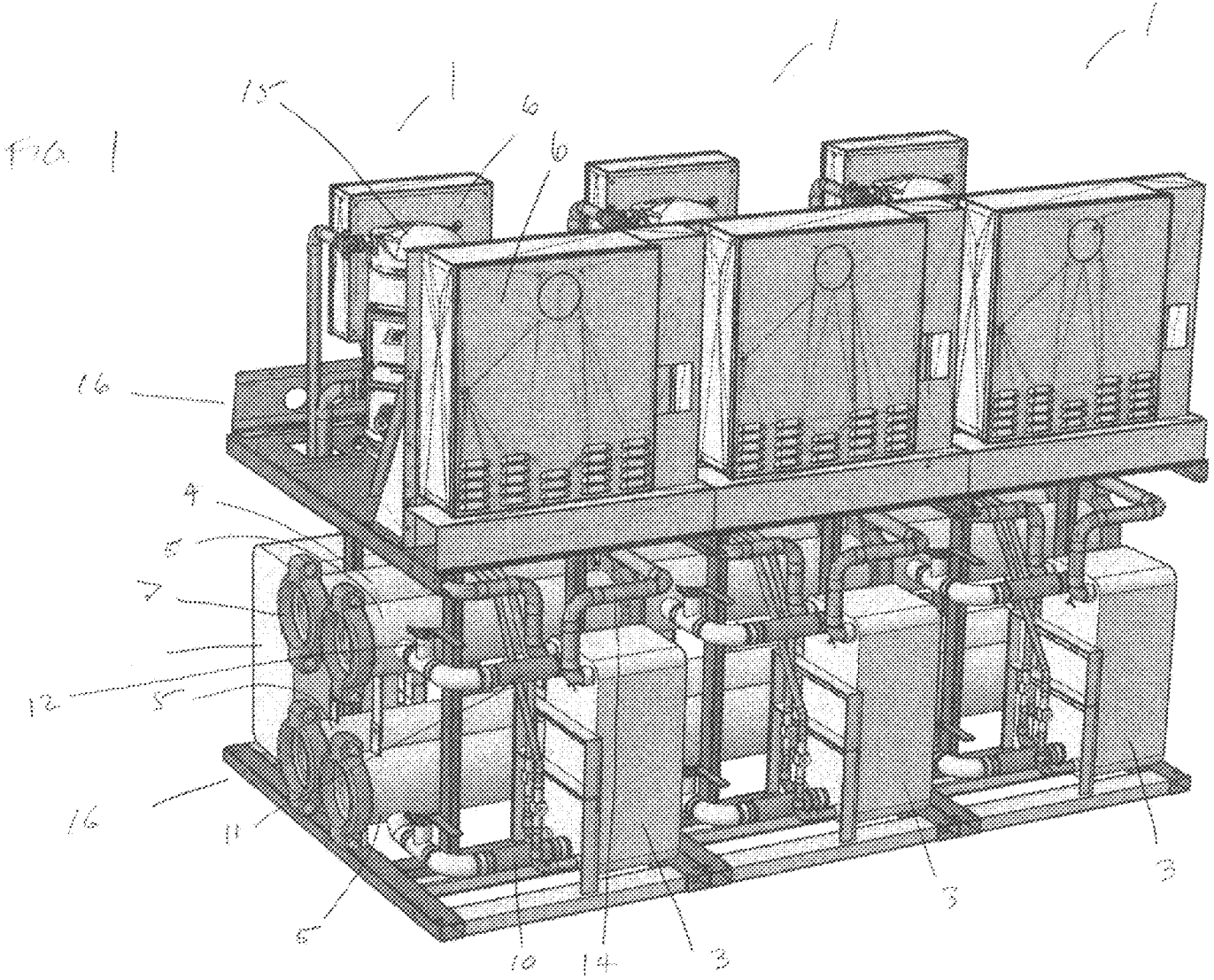
FIG. 1 is a perspective view of a plurality of interconnected modular refrigeration units in accordance with the present invention.
Figure 2:
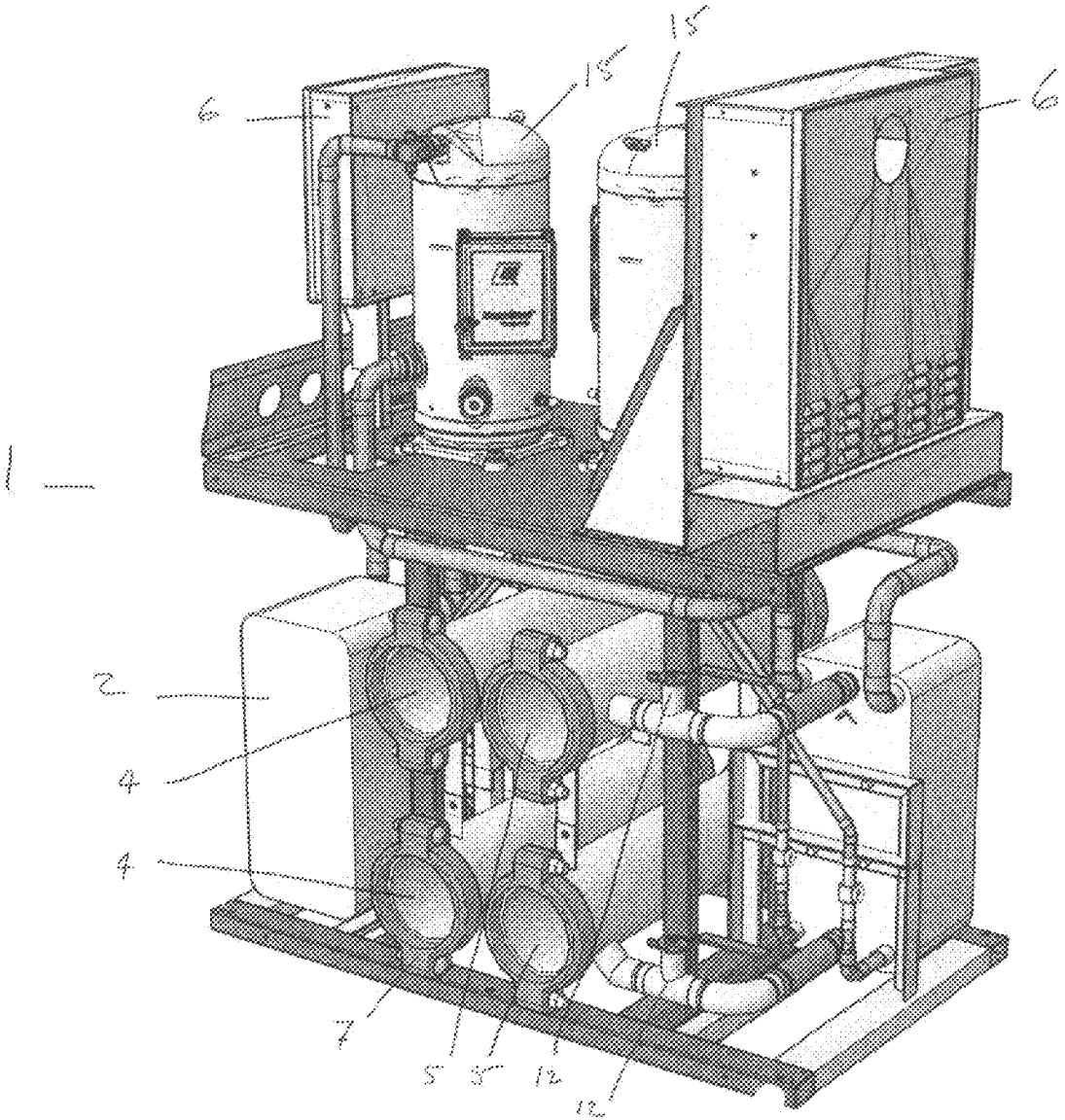
FIG. 2 is a perspective view of one modular refrigeration unit in accordance with the invention.
Figure 3:
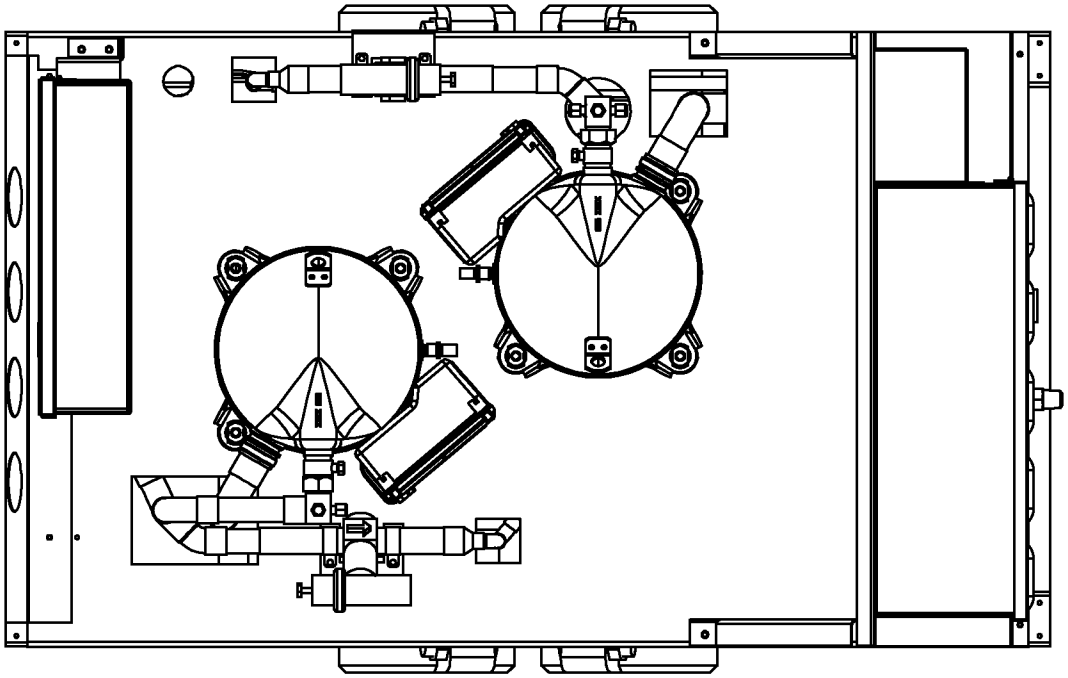
FIG. 3 is a top view of a modular unit.
Figure 4:
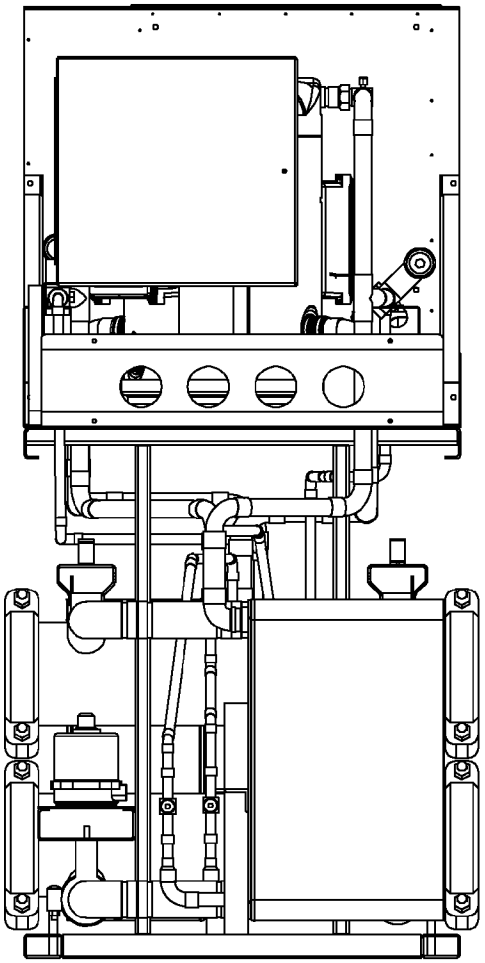
FIG. 4 is a side view of a modular unit.
Figure 5:
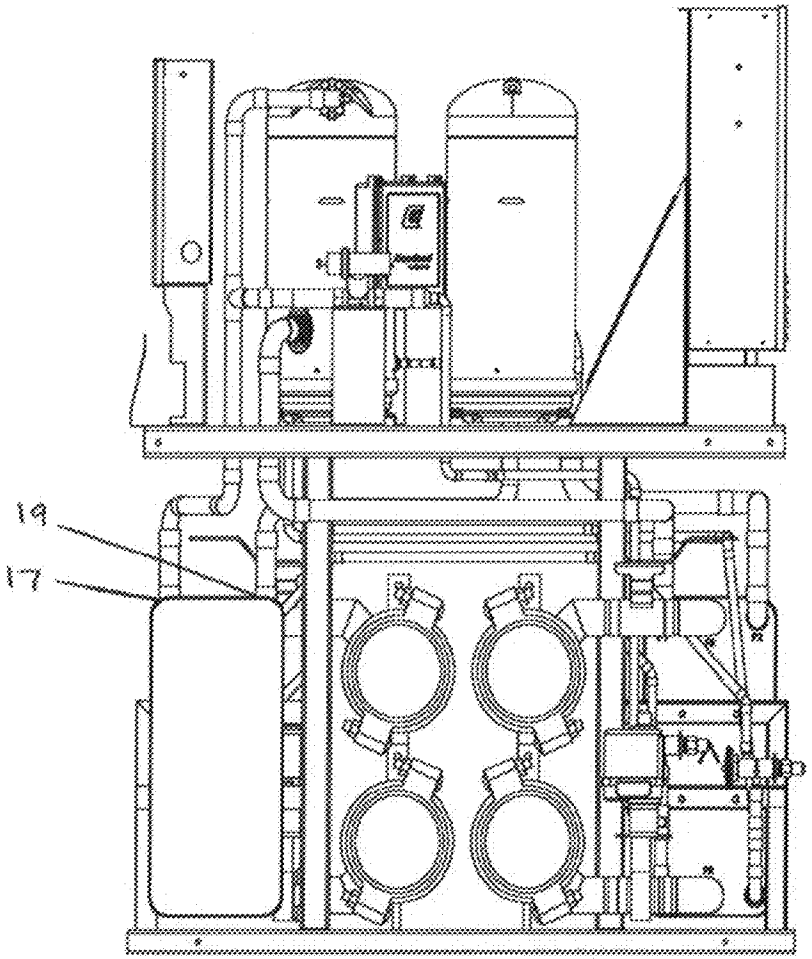
FIG. 5 is a side view of a modular unit.
Figure 6:
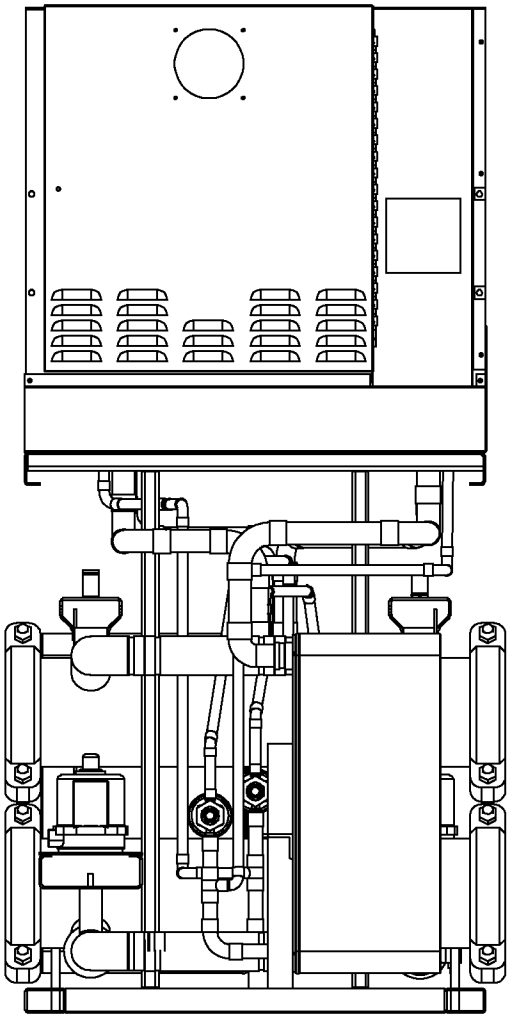
FIG. 6 is a side view of a modular unit.

With reference to FIG. 1, a refrigeration system for use in an air conditioning installation, particularly a high capacity installation, comprises a series of modules 1 arranged in face-to-face relation. As shown in FIGS. 1 to 6, each module comprises a support structure 16 on which is mounted two sealed unit refrigeration compressors 15. The support structure 16 is a two-level arrangement, a horizontal bottom structure, a horizontal top structure, and vertical load bearing structures connecting the top and bottom structures. The structure 16 is divided into two compartments, a top and a bottom area. The bottom area contains at least one evaporator 2 and one condenser 3. An appropriate refrigerant expansion device (not shown) is connected between the respective evaporator 2 and condenser 3 of each refrigeration circuit. It has been found that the conventional modular system having the header pipes 4,5 mounted outboard, and the evaporator 2 and condenser 3 mounted inboard of the header pipes 4,5 presents serious drawbacks to a modular system. One large drawback is that the heat exchangers, which are one of the high maintenance elements of the system, are extremely difficult to access when mounted inboard. It would normally be required to shut down the entire system, remove the header pipes 4,5 blocking access to the evaporator 2/condenser 3 and then after servicing the evaporator 2/condenser 3, reinstalling and reconnecting both the evaporator 2/condenser 3 equipment and the header pipes 4,5 before restarting the entire system.

The present invention overcomes the serious drawbacks by new structure associated with a modular system. In the new invention, the header pipe 4,5 are arranged in the interior of the module 1, inboard of either or both of the evaporator 2 and/or condenser 3. The evaporator 2 and the condenser 3 are mounted at the outermost region of each modular unit 1. This allows for removal and/or servicing of the evaporator 2/condenser 3 without the need for disturbing the header pipes 4,5 and therefore without the need to shut down the entire system during removal and/or servicing of the evaporator 2/condenser 3.

The evaporator 2 and/or condenser 3 are isolatable from the evaporator header pipe 4 and/or the condenser header pipe 5, respectively, by an evaporator isolation valve 13 and/or a condenser isolation valve 12. The evaporator isolation valve 13 is arranged in a manner similar to the condenser isolation valve 12 shown in the figures. Either one or both of the evaporator 2 and condenser 3 have valves positioned between the evaporator 2/condenser 3 heat exchanger and the respective header pipes 4,5. The valves are on one or both of the supply and/or return conduits or pipes, and are arranged in a manner such that they are open during normal operation of the module, but can be closed when it is desired to isolate the evaporator 2/condenser 3 from the respective fluid connection with the respective header pipe.

Likewise, isolation valves may be positioned on the refrigerant fluid supply and return pipes, making the respective evaporator 2/condenser 3 easily removable and replaceable.

Isolating the evaporator 2/condenser 3 from their respective header pipe facilitates several advantages over the prior art. If a leak is detected in one of the evaporator 2/condenser 3 units, that unit can be immediately isolated and the leak stopped by merely closing the isolation valves. Then the evaporator 2/condenser 3 may be serviced and/or removed at a convenient time, without the necessity of an immediate shutdown of the entire modular system in order to address the leak. Meanwhile, the fluid in the respective header pipes continues to flow normally through the header pipes, and through all the other operational evaporator 2/condenser 3 elements.

By being positioned outboard of the other components, the evaporator 2/condenser 3 may be isolated and removed with great ease. Other problems aside from leaks, such as blockages and other failures, can easily be remedied by the structure of the present invention. Further, by isolating the compressor 15 from the evaporator 2/condenser 3 by closing the refrigerant isolation valves 18, compressor problems can likewise be easily addressed.

To further enhance the serviceability of the evaporator 2/condenser 3/compressor 15, quick-release couplings may be incorporated between the isolation valves 13,12,18 and the respective evaporator 2/condenser 3 and/or compressor 15. This will allow for extremely simple isolation and removal of the respective element.

The bottom area accommodates separate fluid flow passages which serve to carry separate flows of heat exchange fluid, for example water, in heat exchange relation with the evaporator 2 and the condenser 3.

The heat exchange fluid, i.e. water, which is to be cooled by the evaporator 2, is supplied to the evaporator 2 by a header pipe 4 mounted on structure. The header pipe 4 has an opening which communicates with an inlet extending from the evaporator 2.

Cooled water is taken from evaporator 2 through the header pipe 4. The lower header pipe has an opening, which communicates with an evaporator 2.

Header pipes 5 are mounted on the support structure 16 and communicate with the condenser 3 by similar openings and tubes, respectively. The header pipe conveys cooling fluids such as water to the condenser 3, the cooling water being removed through the header pipe 5.

Each of the header pipes 4,5 are of a length enabling end-to-end connection with corresponding header pipes of adjacent modules 1 to form a common series of fluid manifolds. A coupling which may be releasable is generally indicated at 7, and is used to form fluid tight connections between the pipe ends. The releasable coupling may be a compression style, or may be flanged, bolted, or sleeve type. In one embodiment the releasable couplings are releasable and then reattachable. The coupling may also be welded, requiring cutting to separate the units, or may be chemically attached. The coupling may be any style of coupling known to connect two headers or pipes. End caps are used to seal the ends of the header pipes of the last module 1 of the assembly while appropriate fluid supply and return lines (not shown) are connected to the header pipes of the first module 1.

Pipes 14 for conveying refrigerant between the compressors 15, condensers 3 and evaporators 2, respectively extend down and through the support structure 16 to the respective heat exchangers.

There may be side walls on each side of the support structure which are removable to give access to the components. The side walls may be sealed against the modules bottom wall, the top wall on which the compressors are mounted, the partition, and the front and rear walls to ensure that the compartments are fluid tight. It will be appreciated, however, that the evaporator coils and the condenser can be incorporated in a series of one or more independent heat exchange devices which define the separate passageways for the respective fluids, thus obviating the need to provide a fluid tight compartment. Support structure 16 may have mounted upon it an electrical bus bar to which the compressors 15 and other devices are electrically connected. The bus bar has appropriate connections at each end to enable the bus bars of adjacent units to be interconnected to provide continuity of electrical power supply to each unit.

Although the compressors 15 mounted on the top wall of the support structure 16 may be exposed, it is preferred that a top cover is provided over the compressors 15. The top cover is removable without removing the respective module from the assembly to facilitate service and maintenance. Removable front and rear cover plates, respectively, may also be provided.

As described above, each module 1 comprises a separate refrigeration unit comprising two refrigeration circuits. The refrigeration circuits of each unit are, essentially, independent of those of each of the other modules, with each circuit including its own control means in order to control and/or deactuate the refrigeration unit in the event of an overload or other malfunction occurring in that unit. The control means includes an electrical control box 6 mounted on the top of the support structure 16. The control box 6 receives signals from sensors (not shown) associated with operation of the refrigeration units and transmits those signals through electrical connections to a master control panel in the system, preferably an end module. The master control panel houses the electrical control circuits for the control of the assembly of modules 1 in accordance with the desired operation or control of the air conditioning installation whereby the cooling effect of the system (or the heating effect if the refrigeration units are acting in a reverse cycle mode, or the heat recovery effect) meets the instantaneous requirements of the air conditioning installation. Under part load conditions, the control circuits are operative to actuate only one or some of the modules 1 (depending on the load) with other units being brought into operation as the load increases. Advantageously, the control circuits are operative to automatically switch, at predetermined intervals, the order in which the modules 1 are brought into operation in order to substantially equalize the usage of the individual modules over a prolonged period of time. The control circuits may include memory circuits which maintain a constant record of the hours of operation of each module 1, the information being used to ensure substantial equalization of usage of the individual modules over a period of time.

A microprocessor can be used to control the progressive switching functions and to match operation of the refrigeration system to the load requirements of the air conditioning installation to which the system is connected.

The modular construction described permits additional slave modules 1 to be added to the assembly in order to increase the capacity of the refrigeration system resulting from changes in load criteria of the air conditioning installation. In the event of a malfunction in one of the modules 1, that module may be shut down by the control circuits, while permitting continued operation of the other modules. Depending on the fault, the defective module may be repaired in situ while the system is in operation, or the defective module may be removed from the assembly for repair, a spare module being incorporated in the assembly to replace the removed, defective module or the assembly being permitted to operate without a replacement. Naturally, if a module is removed from the assembly for repair or maintenance, the header pipes 4,5 of the modules 1 on each side of that to be removed are connected together by temporary pipe connections to maintain the heat exchange fluid circuits. Similar temporary electrical connections are also made.

One embodiment uses a single compressor, the housing having a single compartment for the evaporator coil while the condenser coil is located in an air cooling chamber located above the compressor. Fans draw air through the chamber to cool the finned condenser coil.

In some installations, an evaporative condenser is used and for this purpose water sprays spray water over the condenser coil.

A refrigeration system formed in accordance with the present invention utilizing a number of modules 1 assembled together to form a single unit will have a reliability related to the reliability of the individual modules 1, which is substantially better than the reliability of a single refrigeration unit of equivalent output. The reliability is further enhanced, in accordance with the invention, by the continued operation of other modules of an assembly if one module is shut down for repair or maintenance. A system of increased capacity can be obtained in accordance with the invention simply by adding additional modules, as required, to take account of any increase in load resulting from a building extension or the like.

The use of header pipes to form common manifolds for supply and return of heat exchange fluid facilitates interconnection of the separate refrigeration units and allows modular construction of identical units which can be mass produced for relatively less cost than fabricated units. The modular units are readily assembled into complete units of any desired capacity.

As indicated above, the refrigeration circuits may be adapted for reverse cycle operation, and for heat recovery use, if desired.

It will be understood that the refrigeration system of the invention can be used for purposes other than air conditioning installations. Thus, the modular system is particularly useful for cool storage, cool rooms and freezer rooms in food processing and handling industries and in any other area requiring the use of relatively large capacity refrigeration.

1. Module
2. Evaporator Heat Exchanger
3. Condenser Heat Exchanger
4. Header Pipes for Cooling Load Evaporator Heat Exchange Fluid
5. Header Pipe for Condenser Cooling Fluid
6. Control Box
7. Releasable Coupling
8. Evaporator Cooling Load Heat Exchange Fluid Inlet
9. Evaporator Cooling Load Heat Exchange Fluid Outlet
10. Condenser Cooling Fluid Inlet
11. Condenser Cooling Fluid Outlet
12. Condenser Isolation Valve
13. Evaporator Isolation Valve
14. Refrigerant Supply Conduit
15. Compressor
16. Support Structure
17. Evaporator Cooling Fluid Inlet
18. Refrigerant Isolation Valve
19. Evaporator Cooling Fluid Outlet

The invention claimed is:

1. Air conditioning apparatus, comprising:

a plurality of modular air conditioning units, connected together to provide cooling load via a common header pipe arrangement, each of said modular units having a compressor, at least one evaporator heat exchanger having at least one cooling load heat exchange fluid inlet, at least one cooling load heat exchange fluid outlet, at least one cooling fluid inlet and at least one cooling fluid outlet, at least one condenser heat exchanger having at least one cooling fluid inlet and at least one cooling fluid outlet, at least one header pipe for cooling load evaporator heat exchange fluid, at least one header pipe for condenser cooling fluid, a plurality of condenser isolation valves, a plurality of evaporator isolation valves, and a support structure, said condenser and said evaporator each being fluid-isolatable via said condenser isolation valves and said evaporator isolation valves, respectively, at least one of said condenser and evaporator are positioned outboard of said header pipes and are removable from said modular unit unimpeded by said header pipes, said header pipes remaining connected during removal of said condenser and/or evaporator, wherein operation of said air conditioner apparatus is uninterrupted during removal of said condenser and/or evaporator.

2. The air conditioning apparatus as defined in claim 1, wherein at least one of said condenser and evaporator are disposed at an outer periphery of said modular unit, outboard of said header pipes.

3. The air conditioning apparatus as defined in claim 1, wherein both of said condenser and evaporator are disposed at an outer periphery of said modular unit, outboard of said header pipes.

4. The air conditioning apparatus as defined in claim 2, wherein said header pipes are connectable via releasable and reattachable couplings.

5. The air conditioning apparatus as defined in claim 3, wherein said header pipes are connectable via releasable and reattachable couplings.

* * * * *